United States Patent [19]

Temple et al.

[11] 4,116,854

[45] Sep. 26, 1978

[54] DETERGENT COMPOSITIONS CONTAINING STARCH

[75] Inventors: Robert Dwight Temple; William Thomas Bryan; Carl Joseph Willig, all of Cincinnati, Ohio

[73] Assignee: The Procter & Gamble Company, Cincinnati, Ohio

[21] Appl. No.: 768,675

[22] Filed: Feb. 14, 1977

[51] Int. Cl.[2] ..... C11D 3/22; C11D 3/43

[52] U.S. Cl. ..... 252/167; 252/8.6; 252/89 R; 252/130; 252/154; 252/155; 252/163; 252/164; 252/165; 252/166; 252/DIG. 2

[58] Field of Search ..... 252/89 R, 162, 163, 252/164, 165, 166, 167, 168, 130, 154, 155, 8.6, 8.7, DIG. 2

[56] References Cited

U.S. PATENT DOCUMENTS 3,892,681 7/1975 Edwards et al. ..... 252/551

*Primary Examiner*—Harris A. Pitlick

*Attorney, Agent, or Firm*—Robert B. Aylor; Richard C. Witte; Thomas H. O'Flaherty

[57] ABSTRACT

Laundry detergent compositions comprising an organic surface-active agent and low concentrations of substantially water-insoluble starch which contains from about 0.01% to about 5% by weight of a substantially water-insoluble organic liquid; said composition imparting anti-wrinkling and ease of ironing effects to fabrics washed therein.

12 Claims, No Drawings

DETERGENT COMPOSITIONS CONTAINING STARCH

BACKGROUND OF THE INVENTION

This invention relates to laundry detergent compositions of the type disclosed in U.S. Pat. No. 3,892,681, said patent being incorporated herein by reference. The starches disclosed in the U.S. Pat. No. 3,892,681 specification are, in general, very dusty and difficult to handle. Furthermore, although the products of the U.S. Pat. No. 3,892,681 patent improve wrinkling as set forth therein, it is always desirable to improve the performance of such compositions.

By utilizing certain materials as set forth herein, it is possible to minimize the dustiness of the starches and improve their anti-wrinkling performance.

SUMMARY OF THE INVENTION

The instant invention provides detergent compositions which are capable of concurrently cleansing and imparting desirable fabric properties to the fabrics laundered therein. Such compositions comprise:

(a) from about 4% to about 60% by weight of an organic surface-active agent selected from the group consisting of anionic, nonionic, zwitterionic and ampholytic detergents and mixtures thereof; and (b) from about 0.1% to about 6% by weight of a granular substantially water-insoluble starch having an average particle diameter of from about 1 to about 45 micrometers and a swelling power of less than about 15 at a temperature of 65° C., said starch also containing from about 0.01% to about 5% by weight of a substantially water-insoluble organic liquid.

A method aspect of this invention relates to a method for treating fabrics to simultaneously cleanse and impart anti-wrinkling and ease of ironing, comprising treating fabrics in an aqueous liquor comprising:

(a) from about 10 ppm (parts per million) to about 5000 ppm of an organic surface-active agent selected from the group consisting of anionic, nonionic, zwitterionic and ampholytic detergent and mixtures thereof; and (b) from about 0.1 ppm to about 900 ppm of granular substantially water-insoluble starch having an average particle diameter of from about 1 to about 45 micrometers and a swelling power of less than about 15 at a temperature of 65° C., said starch containing from about 0.01% to about 5% by weight of substantially water-insoluble organic liquid.

DETAILED DESCRIPTION OF THE INVENTION

The ingredients including the starch, anionic detergent, nonionic synthetic detergents, ampholytic synthetic detergents, zwitterionic synthetic detergents, clays, detergent builder salts, etc. which can be present in the compositions of this invention are fully described in U.S. Pat. No. 3,892,681 which is incorporated herein by reference.

As discussed hereinbefore, the starches of this invention differ from the starches of the U.S. Pat. No. 3,892,681 invention by virtue of containing from about 0.01% to about 5%, preferably from about 0.05% to about 2.0%, most preferably from about 0.1% to about 0.5% of a substantially water-insoluble organic liquid. Preferred water-insoluble organic liquids include mineral oils, triglycerides, fatty acids, fatty alcohols, alkyl benzenes, alcohol ethoxylates, fatty amines and ammonium compounds, and mixtures thereof. Preferably the liquid will boil above about 140° F., more preferably above about 150° F. The most preferred water-insoluble organic liquid is a mineral oil composed primarily of hydrocarbons in the $C_{18}$to $C_{36}$ range having a Saybolt viscosity at 100° F., preferably between about 50 and 300.

The preferred starch for use herein is corn starch.

PROCESS ASPECTS OF THE INVENTION

Contrary to the teachings found in U.S. Pat. No. 3,892,681, it has now been discovered that it is possible to incorporate the starch disclosed herein into a spray-dried detergent granule by incorporating the starch into the crutcher mix prior to spray drying. Preferably the conditions of the crutcher are such that only a minimal amount of the starch is degraded. These conditions, of course, will have to take into account the time the starch is exposed to the crutcher mix, the temperature of the crutcher mix, the other ingredients of the detergent mix, etc. The combination of all the factors must be adjusted as is well known in the art so as to avoid degradation of the starch and removal of the water-insoluble organic liquid.

Preferably the temperature of the crutcher mix should be kept as low as possible, preferably below the gelation temperature of the starch which is normally in the range of about 170° F. to about 180° F.

As a result of applicants' discovery, it is possible to prepare a spray-dried detergent granule containing the aforementioned starch treated with the water-insoluble organic liquid. It should be noted, of course, that when the starch is added by way of the crutcher mix, the water-insoluble organic liquid should not be volatile below the crutcher mix temperature.

In a preferred method of incorporation, the starch can be added to a slurry composed of any silicate that may be present, optical brighteners, colorants, etc. This slurry can then be added to the crutcher along with the other ingredients. Typically the crutcher mix is heated to a temperature range of from about 150° F. to about 160° F. and then atomized in a spray-drying tower.

EXAMPLE I

A spray-dried detergent composition was prepared containing 12% sodium dodecylbenzene sulfonate, 8% sodium $C_{14-15}$ alcohol polyethoxylate (1.0) sulfate, 24.4% sodium tripolyphosphate, 33.8% sodium sulfate, 12% of 2.0 ratio sodium silicate, and the balance minor ingredients and moisture.

The above composition was tested against the same composition with 0.5% of corn starch added and against the same composition with 0.5% of corn starch which had been treated with about 0.15% mineral oil to position the relative anti-wrinkling benefits of the three products. The starches were added to the detergent composition in the crutcher which was kept below 170° F. at about 150°-160° F. Shirt-back panels (polyester/-cotton fabric) were washed in each of the three compositions and dried for several cycles. These panels were then round-robin paired and comparison graded by three judges for the last four cycles of the test. Usually there are four replicates of three colors of the shirt panels in each test. Visual preferences are recorded after the drying cycle using a 0 to 4 scale where: 0 equals no difference and 4 equals a very large difference. The panels were washed in a Kenmore top-loading automatic washer set at about 100° F. using 17 gallons of 7 grains hardness water and 77 grams of product.

The results were as follows. The detergent alone gave panels which had a relative wrinkle appearance with a grade defined as 0; the detergent plus 0.5% of normal corn starch gave fabrics with a relative wrinkle appearance grade of 1.3; and the detergent containing 0.5% of the mineral oil treated starch gave fabrics with a relative wrinkle appearance grade of 2.1. The least significant difference in this test was 0.2 units at the 95% confidence level.

The same three detergent compositions were also tested to position their relative ease-of-ironing benefits. Cotton handkerchiefs were washed for several cycles in each detergent composition, as described in connection with the wrinkling test. Pairs of the handkerchiefs were then ironed by a panel of thirty judges, who selected which of the pair they found easier to iron. The results showed that the detergent with 0.5% normal starch and the detergent containing 0.5% mineral oil treated starch gave fabrics equally easy to iron, while the detergent without starch gave fabrics judged significantly more difficult to iron.

Substantially the same wrinkling and ironing results were obtained using detergents prepared by incorporating the two starch materials into the detergent composition by uniformly admixing the spray-dried detergent granules with the starch granules. The results were also substantially the same using detergents prepared by spraying an aqueous dispersion of starch granules onto the spray-dried detergent granules followed by removal of excess moisture.

EXAMPLE II

A detergent composition is prepared containing 11% sodium tallow alkyl sulfate, 9% sodium dodecylbenzene sulfonate, 47% sodium tripolyphosphate, 11% sodium sulfate, 5% of 1.6 ratio sodium silicate, and the balance minor ingredients and moisture. When this composition is tested against the same composition with 1.0% rice starch which has been treated with about 0.3% mineral oil using the wrinkling test and ease-of-ironing tests conducted as outlined in Example I, the fabrics laundered in the detergent containing oil-treated starch will be least wrinkled, those laundered in the detergent containing the normal rice starch will be next, and those laundered in the starch-free detergent will be most wrinkled. Ease-of-ironing results will show both starch-containing compositions better than starch-free compositions. Results will be substantially the same when the starch materials are added to the detergent via the crutcher, or are admixed with the spray-dried detergent granules.

EXAMPLE III

A detergent composition is prepared containing 14% sodium dodecylbenzene sulfonate, 6% sodium $C_{14-15}$ alcohol polyethoxylate (3.0) sulfate, 20% sodium carbonate, 31% sodium sulfate, 20% of 2.4 ratio sodium silicate, and the balance minor ingredients and moisture. When this composition is tested against the same composition with 0.3% corn starch and against the same composition with 0.3% corn starch which has been treated with about 0.1% soybean oil, wrinkling and ease-of-ironing tests conducted as in Example I will give substantially the same results.

EXAMPLE IV

A detergent composition is prepared containing 12% $C_{12-14}$ alcohol polyethoxylate (4.0), 10% sodium carbonate, 25% aluminosilicte zeolite Type A $$Na_{12}(AlO_2 \cdot SiO_2)_{12} \cdot 27\ H_2$$

with average particle diameter of about 3 microns, 24% sodium sulfate, 23% of 2.0 ratio sodium silicate, and the balance minor ingredients and moisture. When this composition is tested against the same composition with 1.5% wheat starch and against the same composition with 1.5% wheat starch which has been tested with about 0.05% hexadecanol, wrinkling and ease-of-ironing tests conducted as in Example I will give substantially the same results.

EXAMPLE V

When in the above Examples and in the Examples of U.S. Pat. No. 3,892,681, the starches are treated with coconut oil, tallow fatty acids, $C_{18-20}$ fatty alcohols, $C_{12-18}$ alkyl benzene, tallow fatty alcohol ethoxylate, $C_{20}$ alcohol polyethoxylate (2), tallow alkyl dimethyl amine, coconut trimethylamminium chloride, and 1:1 mixtures thereof, essentially equivalent results are obtained in that the wrinkle appearance of washed clothing is improved.

What is claimed is:

1. A laundry detergent composition comprising:

(a) from about 4% to about 60% by weight of an organic surface-active agent selected from the group consisting of anionic, nonionic, zwitterionic and ampholytic detergents and mixtures thereof; and (b) from about 0.1% to about 6% by weight of granular substantially water-insoluble starch having an average particle diameter of from about 1 to about 45 micrometers and a swelling power of less than about 15 at a temperature of 65° C., said starch containing from about 0.01% to about 5% by weight of a substantially water-insoluble organic liquid.

2. A composition according to claim 1 wherein the organic liquid is present in an amount from about 0.05% to about 2.0% by weight of the starch.

3. A composition according to claim 2 wherein the organic liquid is present in an amount from about 0.1% to about 0.5% by weight of the starch.

4. A composition according to claim 1 wherein the organic liquid is mineral oil.

5. A composition according to claim 4 wherein the organic liquid is present in an amount from about 0.05% to about 2.0% by weight of the starch.

6. A composition according to claim 4 wherein the organic liquid is present in an amount from about 0.1% to about 0.5% by weight of the starch.

7. A composition according to claim 1 in which the granular starch material is corn starch.

8. A composition according to claim 7 wherein the organic liquid is mineral oil.

9. A composition according to claim 1 when the starch is present in an amount of from about 0.2% to about 2% by weight of the detergent composition.

10. The composition of claim 1 in the form of a spray-dried granule.

11. The process of preparing the composition of claim 10 comprising the steps of incorporating the starch material into the crutcher mix, then spray-drying the mixture.

12. The process of claim 11 wherein the temperature of the crutcher mix is kept below about 170° F. and the time the starch is in the crutcher mix is minimized.

* * * * *